US005080154A

United States Patent [19]

Kallesöe

[11] Patent Number: 5,080,154

[45] Date of Patent: Jan. 14, 1992

[54] METHOD AND APPARATUS FOR GLUING WOODEN STAVES

[75] Inventor: Herluf Kallesöe, Lem, Denmark

[73] Assignee: H. Kallesoe Maskingabrik A/S, Lem St., Denmark

[21] Appl. No.: 571,604

[22] PCT Filed: Feb. 23, 1989

[86] PCT No.: PCT/DK89/00042

§ 371 Date: Oct. 25, 1990

§ 102(e) Date: Oct. 25, 1990

[87] PCT Pub. No.: WO89/08016

PCT Pub. Date: Sep. 8, 1989

[30] Foreign Application Priority Data

Feb. 25, 1988 [DK] Denmark ..... 976/88

[51] Int. Cl.[5] ..... B27D 1/00

[52] U.S. Cl. ..... 144/352; 144/2 R; 144/242 M; 144/245 R; 144/249 A; 144/350; 144/355; 156/299; 156/304.1; 156/566

[58] Field of Search ..... 156/304.1, 299, 566; 144/2 R, 346, 350, 351, 352, 242 M, 245 R, 249 R, 249 A

[56] References Cited

U.S. PATENT DOCUMENTS

| | | | |
|---|---|---|---|
| 3,277,939 | 10/1966 | Scott | 144/355 |
| 3,616,090 | 10/1971 | Larson | 156/566 |
| 3,990,937 | 11/1976 | Knowles | 144/352 |
| 4,342,615 | 8/1982 | Koch, II | 156/249 |
| 4,797,169 | 1/1989 | Aizawa et al. | 156/299 |

FOREIGN PATENT DOCUMENTS

| | | | |
|---|---|---|---|
| 545466 | 3/1977 | U.S.S.R. | 144/352 |

*Primary Examiner*—W. Donald Bray
*Attorney, Agent, or Firm*—Antonelli, Terry, Stout & Kraus

[57] ABSTRACT

A method and apparatus for automatically feeding stave members wherein each newly introduced stave is laterally automatically displaced inwardly against a free edge of a previously laid out layer of stave members such that a close connection is achieved by successive displacements of only a single stave member at a time. A feeder feeds the stave members from a stationary feeding area and a feeding carriage picks up the stave members and delivers the stave members to a carrier surface.

10 Claims, 2 Drawing Sheets

METHOD AND APPARATUS FOR GLUING WOODEN STAVES

FIELD OF THE INVENTION

The present invention relates to a method and apparatus for laying out glue smeared wooden stave members on a receiving area in preparation for production of a wooden plate body formed by the stave members in a compressed and glued condition.

BACKGROUND OF THE INVENTION

Generally a procedure for laying out stave members on a receiving area is normally performed purely manually even though such approach is somewhat inconvenient. While mechanical auxiliaries have been proposed, such mechanical auxiliaries have not met with any particular success because it can hardly be relied upon to push a layer of stave members across the receiving areas.

It has been suggested to perform a laying-out of a single row of stave members in a side-by-side relationship on a support which could then be moved across the receiving area and be withdrawn while the layer of stave members is held in position so as to be brushed off to fall down onto the receiving area; however, the mere withdrawal of a support in relationship to the glue smeared stave members may disarrange the stave members and, all things considered, the delivery to the receiving area takes place in a rather haphazard fashion.

SUMMARY OF THE INVENTION

The aim underlying the present invention essentially resides in providing a method by which a laying out of stave members can be effected automatically in a safe and suitable manner. In accordance with advantageous features of the present invention, a conveyor belt is employed which, from a stave-member receiving front end, is moved a step rearwardly every time a transverse row of stave members has been laid out thereon, and the stave members are lead to this area by a stepwise transversely movable feeding carriage which individually receives the stave members and leads the stave members through glue applying side rolls to feed onto a front of the receiving belt, with the feeding carriage and/or the conveyor chassis having pusher means located above the conveyor belt so as to move in synchronism with the carriage in order to push each newly introduced stave member laterally against the proceeding introduced stave member or against a fixed side land along the conveyor belt, respectively.

By virtue of the above noted features of the present invention, the individual stave members, upon an appropriate inspection, can then just be delivered to the carriage which will operate to pass the stave members through a suitable glue applicator to enable an easy individual introduction on the receiving area, where the individual stave members are displaced sidewards to engagement against the latest introduced stave member. Whereas, it may be difficult to displace a whole row of already laid out stave members at the receiving area due to the adhesion of extravasated excess glue, there is no corresponding problem associated with a lateral displacement of a single layer of stave members; therefore, a row of closely packed stave members can easily be formed when it is only every newly introduced stave member that requires a lateral displacement for successive forming of a closed row of stave members.

When a width of the receiving band has been filled with stave members, the receiving band can be activated by being moved a suitable step forward such that a new row of stave members can be accommodated at the front end of the receiving band. Subsequently, the filled conveyor belt can be utilized directly as a carrier for the rows of stave members in a hot press, where the receiving band can be brought to deliver the rows of stave members to a special carrier surface in such a press.

The feeding carriage moves transversely along the front end of the conveyor belt; however, according to the invention, it achievable that the stave members, in a desirable manner, are delivered from a stationary area, for example, to a delivery conveyor extending along the direction of motion of the carriage next to the carriage.

The carriage may include a gripping bar projecting over the delivery conveyor for stopping the stave members at a particular place in dependence upon a position of the carriage, and means for successively transferring the stave members to the feeding means of the carriage whereby an operator can take up a permanent work position at a front end of the delivery carrier.

By virtue of the features of the present invention, a horizontal impression of the laid-out glue smeared stave members can be carried out whereby comparatively heavy and very steady wooden plate bodies can be made, with such bodies being applicable for table tops and other furniture and construction parts. The receiving area may, for example, be a table that can be rolled into a hot press in which the stave members are forced together at the horizontal level while securing a layer of the stave members by a pressure plate disposed above the layer of the stave members.

The above and other objects, features and advantages of the method and apparatus will become more apparent from the following description when taken in connection with the accompanying drawings which show, for the purpose of illustration only, one embodiment in accordance with the present invention.

Figure 1:
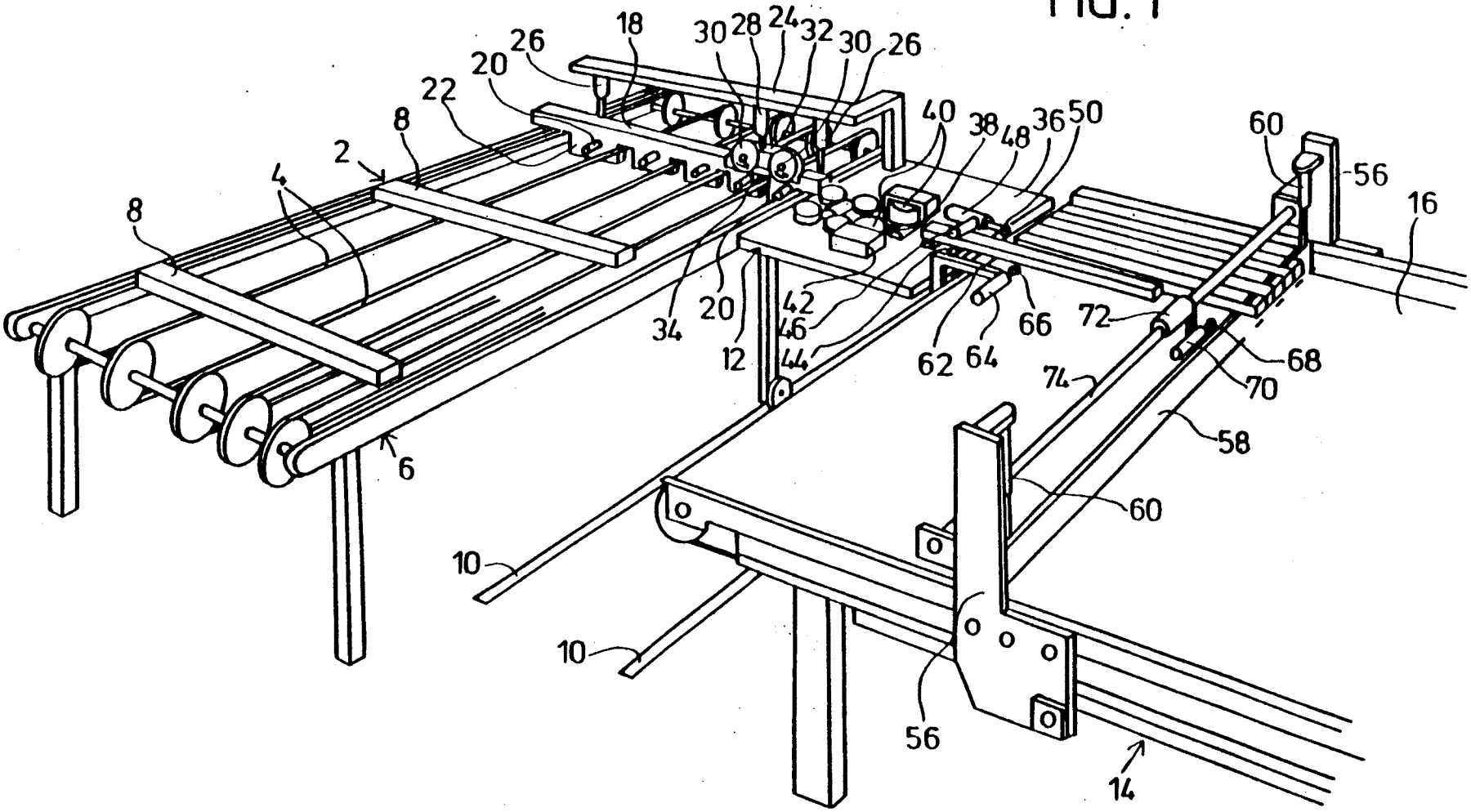
FIG. 1 is a schematic perspective view of a laying-out stave member apparatus constructed in accordance with the present invention.

DETAILED DESCRIPTION:

The illustrated apparatus comprises a delivery conveyor 2 with a series of parallel belts 4 mounted on a stationary conveyor frame 6 and designed for receiving stave members 8 which at the front end are laid successively transversely to the belts 4.

Next to the conveyor 2, on a pair of floor rails 10, is placed a carriage 12 in a gap between the side of the conveyor 2 and the front end of a conveyor 14 placed at right angles to the former and having a wide plate or rail supported conveyor band 16.

The carriage 12 comprises a gripping bar 18, which projects over the conveyor belts 4 and is provided with protruding lower carrier rollers 20 placed on brackets 22 down below the upper surface level of the belts 4, while the bar 18 at the top is suspended in a fixedly guided manner at a stationary carrier arm 24 projecting from the carriage, by lifting cylinders 26. On the arm 24 is also placed a lifting cylinder 28 carrying a pair of slim, rotating driving discs 30 adjacent the front of the bar 18 on a block 32 carried by the cylinder 28.

On the bar 18 is placed an end stop sensor 34 which can react to the arrival of a stave member 8 and thereby activate the cylinders 26 to raising of the bar 18 such that the stave member, by the rollers 20, is lifted away from the belts 4 and up to the somewhat higher level of a table top 36 on the carriage 12, and the cylinder 28 is activated to lower the driving discs 30 from a raised inactive position of the driving disks, whereby these driving discs 30 are pressed against the upper side of the arriving stave and cause a movement of this inwardly over the table top 36 of the carriage 12. In order to protect the upper sides of the staves it might be preferred that the carrier rollers 20 are the driven ones while the discs 30 are passively rotatable thrust wheels.

The caught stave member 8 is hereby pushed onto or into a driving roller conveyor path 38 on the table top 36. The path 38 comprises a pair of rollers 40 for applying glue to the side areas of the stave member, the glue being supplied from a suitable glue store which is only schematically shown at 42.

The stave member is hereby pushed onto the front of the still-standing conveyor band 16 as it leaves the roller path 38 via a roller pair including a lower, driven roller 44 and an overlying, resiliently depressed counter pressure roller 46, for examples, the stave member will be left having its rear end placed immediately in front of this roller pair.

Next to the roller pair 44, 46 is located a cylinder 48 with a thrust pad 50 which in its completely retracted position allows the table 12 to be moved a step forward for a push-in of the next stave without the previously only partly introduced stave hitting the pad 50, and the cylinder 48 is positioned such that the pad 50 by actuation of the cylinder will hit the end of the previously deposited stave and thereby push it all the way onto the belt 16.

On the sides of the belt conveyor 14 is placed, adjustable in the longitudinal direction, a pair of upwardly protruding side brackets 56 which between them carry a transverse plate member 58, which between them carry a transverse plate member 58, which stands upright from the surface of the belt 16 and is raisable from the belt by cylinders 60. In a lowered position, this plate member will constitute a stop for the pushing forward of the stave members 8 when the stave members 8 are pushed forward by the thrust pad 50.

On the carriage 12 is placed a carrier arm 62, which projects over the front end of the conveyer belt 16 and carries a transverse cylinder 64, the piston rod of which comprises a presser foot 66 which can press the stave member 8 that has just entered the band 16 against the row of previously introduced staves. A corresponding presser foot 68 can be placed in connection with a cylinder 70 situated on and below a carrier bushing 72, which itself is situated at a screw spindle 74 between the brackets 56. This spindle 74 is turned so as to displace the cylinder 72 corresponding to the displacement of the cylinder 64 at the movement of the carriage 12, 36 along the floor rails 10, driving means, not illustrated, being provided for causing such displacement of the carriage as the laying out of the stave members 8 on the belt 16 gradually proceeds.

Figure 2:
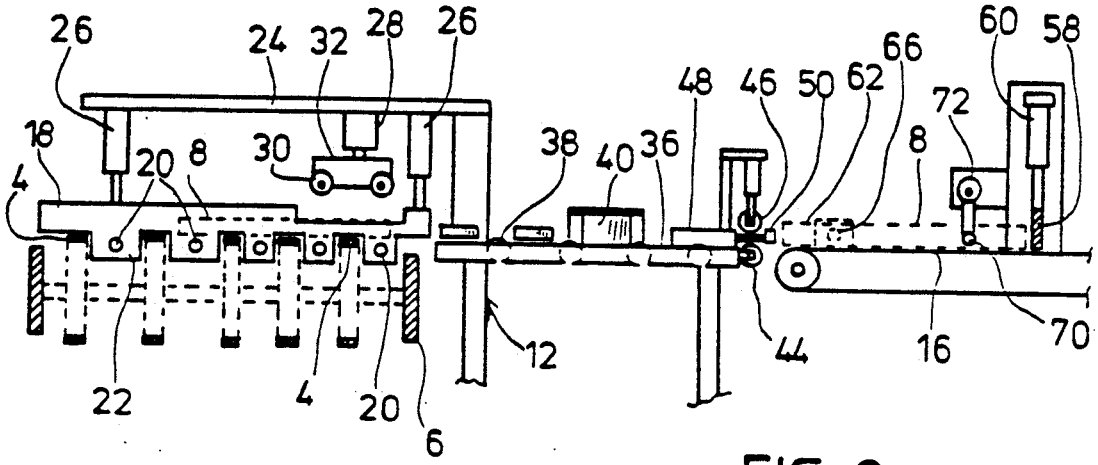
FIGS. 2 and 3 are plan view of the apparatus of FIG. 1.
Figure 3:
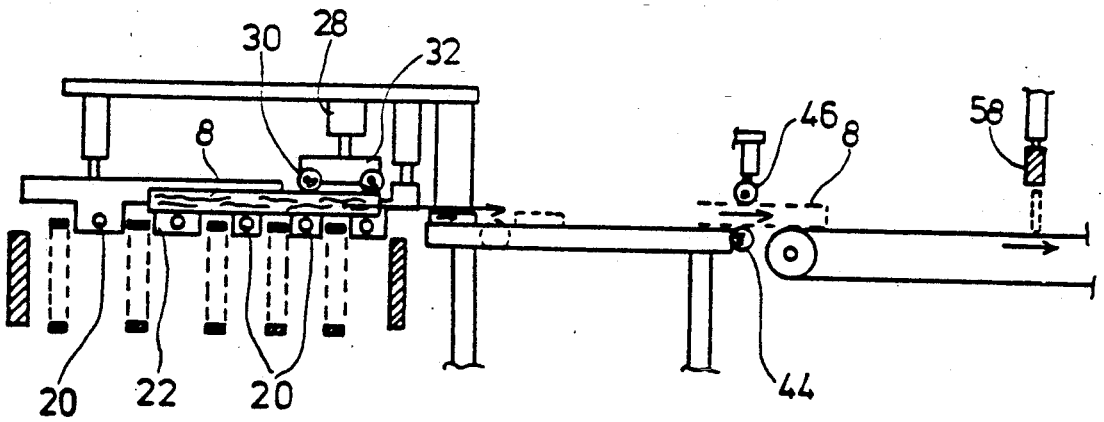

When a transverse layer of stave members 8 thus has been laid out at the front of the belt 16 during successive lateral pushing in of the staves against the already laid stave members 8 it is time to move the belt 16 a step rearward to facilitate a successive laying out of a new transverse layer of staves. To render this movement possible it must be ensured that the cylinders 60 be activated to raise the stopper plate 58, such that the laid out staves can be led past this place. The band 16 is moved such a distance that the laid out stave layer will just pass the plate 18, which is then lowered again, whereafter the laying out of a new layer can be commenced. When the band 16 is suitably filled it can be moved for transfer of the items to a suitable, known press arrangement. FIG. 2 shows the situation where a stave member 8, resting on the belts 4, is moved towards the lowered gripping bar 18 so as to hit this bar in a level above the lower rollers 20, while FIG. 3 shows that the bar 18 is then lifted so as to carry the stave 8 on the rollers 20 into a correct level for the following transfer to the carriage 12. The driving discs 30 are lowered to contact the top side of the stave member 8 for driving it into engagement with the roller conveyor 38 on the carriage 12. Also shown is the driving engagement of a stave member 8 with the roller pair 44, 46 at the delivery side of the carriage 12.

It should be mentioned only briefly that the apparatus naturally should be provided with the necessary sensor and control equipment to ensuring an appropriate automatic progress of the various operations.

What is claimed is:

1. A method for laying out glue smeared wooden stave members on a carrier surface for producing a wooden plate structure consisting of joined stave members, the method comprising the steps of:

individually supplying the stave members to a feeder carriage transversely displaceable relative to the carrier surface along an end edge thereof;

moving the stave members by a moving means on the carriage through a glue smearing means on the carriage for smearing glue on vertical sides of the stave members and thereafter onto the carrier surface; and laterally displacing the stave members on the carrier surface into engagement with a side of a previous stave member by pusher means moved in synchronism with said carriage.

2. A method according to claim 1, wherein the step of individually supplying includes individually supplying the stave members to a feeder conveyor extending along a travel path of the feeder carriage, conveying the stave members on the feeder conveyor with the stave members lying transversely to a direction of conveyance of the feeder conveyor, moving a stave member displacement means along the feeder conveyor in synchronism with the feeder carriage in such a manner that a stave member on the feeder conveyor automatically activates stave member displacement means upon arrival thereto so that the stave member is displaced from the feeder conveyor to the feeder carriage.

3. An apparatus for laying out glue smeared wooden stave members for producing a wooden plate structure consisting of joined stave members, the apparatus comprising:

a carrier surface for receiving the stave members;

a feeding carriage means movable transversely along an edge of the carrier surface for feeding the stave members to the carrier surface;

moving means provided on said feeding carriage means for receiving successively supplied stave members and pushing the supplied stave members forward through a glue applicator on the feeding carriage means to a delivery position on the carrier surface; and a transversely oriented pusher means provided on at least one of the feeder carriage means and the carrier surface and synchronously movable with the feeder carriage means for laterally displacing a latest introduced stave member into engagement with a free side of a previously introduced stave member.

4. An apparatus according to claim 3, wherein said pusher means comprise a first pressure cylinder located above the carrier surface on a carrier arm projecting from the feeding carriage means and a second pressure cylinder located from the first pressure cylinder above the carrier surface and connected with moving means controlled so as to displace said second cylinder synchronously with the movement of the feeding carriage means.

5. An apparatus according to claim 3, wherein said moving means includes a roller conveyor with driven rollers for conveying the stave members and a pusher mechanism for further forward pushing of the stave members upon leaving the roller conveyor.

6. An apparatus according to claim 5, further comprising an upright cross wall member extending transversely over the carrier surface, and wherein said pusher mechanism is adapted to push the respective stave members into abutment with said cross wall member.

7. An apparatus according to claim 6, wherein said carrier surface includes a broad conveyor band, and means are provided for selectively raising and lowering the cross wall member relative to said conveyor band, whereby a laid out layer of stave members on the conveyor band can be moved by the conveyor band when the cross wall member assumes a raised position.

8. An apparatus according to claim 3, further comprising a feeding conveyor means extending in parallel with a travel path of the feeding carriage means and near an intake side of the feeding carriage means for conveying the stave members disposed thereon in a direction transverse to the conveying direction of the feeding conveyor means, and displacement means extending across the feeding conveyor means and movable along the feeding conveyor means in synchronism with the said feeding carriage means for displacing the stave member from the feeding carriage means onto the feeding conveyor means, said displacement means including means for detecting an arrival of a stave member and for actuating the displacement means to displace the stave member from the feeding conveyor means to the moving means of said feeding carriage means.

9. An apparatus according to claim 8, wherein said displacement means is mounted on a carrier arm projecting from the feeding carriage means across and over the feeding conveyor means.

10. An apparatus according to claim 5, wherein the pusher mechanism is mounted next to a side of the roller conveyor so as to be operable to longitudinally push a stave member previously supplied to the carrier surface.

* * * * *